US008651169B2

(12) United States Patent
Nagata et al.

(10) Patent No.: US 8,651,169 B2
(45) Date of Patent: Feb. 18, 2014

(54) ARC MELTING FURNACE APPARATUS

(75) Inventors: Masaki Nagata, Yachiyo (JP); Motohiro Kameyama, Yachiyo (JP); Yoshihiko Yokoyama, Sendai (JP); Akihisa Inoue, Sendai (JP)

(73) Assignees: Diavac Limited, Yachiyo-shi (JP); Tohoku Techno Arch Co., Ltd., Sendai-shi (JP)

( * ) Notice: Subject to any disclaimer, the term of this patent is extended or adjusted under 35 U.S.C. 154(b) by 0 days.

(21) Appl. No.: 13/700,335

(22) PCT Filed: Jun. 1, 2011

(86) PCT No.: PCT/JP2011/003086

§ 371 (c)(1), (2), (4) Date: Nov. 27, 2012

(87) PCT Pub. No.: WO2011/155155

PCT Pub. Date: Dec. 15, 2011

(65) Prior Publication Data

US 2013/0068417 A1 Mar. 21, 2013

(30) Foreign Application Priority Data

Jun. 11, 2010 (JP) ..... 2010-133694

(51) Int. Cl.

| | |
|---|---|
| ***B22D 27/02*** | (2006.01) |
| ***B22D 41/00*** | (2006.01) |
| ***H05B 7/18*** | (2006.01) |
| ***F27D 27/00*** | (2010.01) |
| ***C21B 7/14*** | (2006.01) |

(52) U.S. Cl.

USPC ..... 164/514; 164/335; 373/60; 373/85; 266/233

(58) Field of Classification Search

USPC ..... 373/60–108, 146, 116, 42–45; 266/233–235; 164/514, 335

See application file for complete search history.

(56) References Cited

FOREIGN PATENT DOCUMENTS

| | | | |
|---|---|---|---|
| JP | S60-10199 | U | 1/1985 |
| JP | 2000-317621 | A | 11/2000 |
| JP | 2007-160385 | A | 6/2007 |

OTHER PUBLICATIONS

PCT, "International Search Report for PCT/JP2011/003086", Aug. 9, 2011.

*Primary Examiner* — Kevin P Kerns
*Assistant Examiner* — Steven Ha
(74) *Attorney, Agent, or Firm* — Manabu Kanesaka

(57) ABSTRACT

An arc melting furnace apparatus is provided which reduces an operation burden on a worker and shortens working hours. An arc melting furnace apparatus 1 includes a housing 2 having formed therein a melting chamber 2*a*, a hearth 4 provided within the melting chamber 2*a* and having a recessed portion 4*a*, and a heating mechanism 10 for heating and melting a metal material supplied into the recessed portion 4 to generate an alloy ingot. The apparatus comprises a turning member 23 rotatably supported on a supporting member 21 standing within the melting chamber 2*a*, a perimeter edge of the turning member 23 rotating and moving along the inner surface of the recessed portion 4*a* to lift the alloy ingot generated in the recessed portion 4*a* above the hearth 4 and turn it over, and a resilient turn-over assisting member 24 provided above an upper end of the recessed portion 4*a*. Further, the turn-over assisting member 24 is arranged to flex by a predetermined amount when the alloy ingot abuts it, and to return to its original state from the flexed state so that the alloy ingot is urged to drop into the recessed portion 4*a*.

9 Claims, 10 Drawing Sheets

(a)

(b)

(c)

(a)

(b)

(c)

(a)

(b)

(c)

(d)

ARC MELTING FURNACE APPARATUS

RELATED APPLICATIONS

The present application is National Phase of International Application No. PCT/JP2011/003086 filed Jun. 1, 2011, and claims priority from Japanese Application No. 2010-133694, filed Jun. 11, 2010.

TECHNICAL FIELD

The present invention relates to an arc melting furnace apparatus for melting a metal material.

BACKGROUND ART

Arc melting processes for melting a metal material accommodated in a mold using heat energy of an arc are known conventionally and widely. The arc melting processes include a consumable electrode arc melting process and a non-consumable electrode arc melting process. Of these, the non-consumable electrode arc melting process is such that a tungsten electrode serves as a cathode using a direct-current arc power source in a pressure-reduced argon atmosphere, a direct-current arc is generated between the cathode and the metal material (anode) placed on a water-cooled mold, so that the metal material is melted with heat energy of the arc.

An example of a structure of a non-consumable electrode arc melting furnace of a conventional technology is shown in FIG. 13. In an arc melting furnace 200 as shown, a copper mold 201 is in close contact with a bottom of a melting chamber 210, so that the melting chamber 210 is an airtight container. Further, a tank 202 through which cooling water circulates is provided under the copper mold 201, so that the copper mold 201 is a water-cooled mold.

Further, as illustrated, a rod-like water-cooled electrode 203 is inserted into the chamber through an upper part of the melting chamber 210 and a tip portion made of tungsten as a cathode is arranged to be moved by operating a handle part 204 up and down, back and forth, and to the left and right in the melting chamber 210.

In the case where a metal is melted in this arc melting furnace 200 to obtain an alloy, weighted metal materials are first placed on the copper mold 201. After arranging the inside of the melting chamber 210 to be of an inert gas (usually argon gas), arc electric discharge is generated between the tungsten electrode (cathode) of the water-cooled electrode 203 and the metal material on the copper mold 201 (anode), so that a plurality of different metal materials are melted and alloyed by the heat energy of the discharge.

Incidentally, in an alloy generating process using the arc melting furnace as described above, a metal having a large specific weight is easy to collect at the bottom of alloyed materials. Thus, it is necessary to thoroughly stir the alloy when the alloy is in a melted state in order to generate an alloy of good quality.

However, the molten bottom which is in contact with the mold is cooled, since the metal materials are melted on the water-cooled mold. There is, therefore, a technical problem in that the molten metal located at the bottom changes from liquid phase to solid phase immediately, and sufficient stir cannot be performed.

Then, conventionally, in order to solve the above-mentioned problem, a method has been used in such a way that after cooling an alloy material M which is melted, the material M is turned over on the copper mold 201 with a turning bar 205 which is operated from the outside of the melting chamber 210 as shown in FIG. 14 and melted again, and subsequently the process of cooling, turning, and melting is repeated a plurality of times to knead and alloy the material M. It should be noted that the arc melting furnace as described above is disclosed in Japanese Patent Application Publication No. 2007-160385.

SUMMARY OF THE INVENTION

Problems to be Solved by the Invention

However, in the conventional arc melting furnace as described above, there is a technical problem in that the turning bar 205 has to be operated from the outside of the melting chamber 210 and troublesome work of hooking the material by the tip portion of the turning bar 205 and turning it over has to be carried out a plurality of times, thus its workability is poor and it needs a lot of working hours.

The present invention arises in order to solve the above-mentioned technical problems, and the present invention aims at providing an arc melting furnace apparatus which can reduce an operation burden on a worker and shorten working hours.

Means to Solve the Problems

The present invention made in order to solve the above-mentioned problems is an arc melting furnace apparatus including a housing having formed therein a melting chamber, a hearth provided within the above-mentioned melting chamber and having a recessed portion, and a heating mechanism for heating and melting a metal material supplied into the above-mentioned recessed portion to generate a raw alloy ingot, wherein the above-mentioned apparatus comprises: a turning member rotatably supported on a supporting member standing within the above-mentioned melting chamber in which a perimeter edge of the turning member rotates and moves along an inner surface of the above-mentioned recessed portion to lift the alloy ingot generated in the above-mentioned recessed portion above the hearth and turn it over, and a turn-over assisting member provided above the above-mentioned recessed portion and outside a locus of the above-mentioned turning member, and wherein when the above-mentioned alloy ingot abuts the turn-over assisting member, the above-mentioned alloy ingot is dropped into the above-mentioned recessed portion by the above-mentioned turn-over assisting member.

As described above, the arc melting furnace apparatus of the present invention is provided with the turning member rotatably supported on the supporting member standing within the melting chamber, and the perimeter edge of the turning member rotates and moves along the inner surface of the recessed portion of the hearth to lift the alloy ingot generated in the recessed portion above the hearth and turn it over.

Therefore, according to the present invention, like the conventional technology as described above, the turning bar is operated from the outside of the melting chamber, and it is possible to avoid the skilled but troublesome work of hooking the material and turning it over by the tip portion of the turning bar, reduce the operation burden on the worker, and shorten working hours.

Further, according to the structure of the above-mentioned turn-over assisting member, even if the alloy ingot separates from the turning member and runs out, it abuts (hits) the turn-over assisting member and is rebounded, so that it can be promptly turned over and dropped into the recessed portion.

It is desirable that the above-mentioned turn-over assisting member is formed of a resilient plate so that a concave curve may be formed above the above-mentioned hearth, the turn-over assisting member is supported and fixed at its lower end, and its upper end is formed as a free end, and that when the above-mentioned alloy ingot abuts the above-mentioned turn-over assisting member, the turn-over assisting member flexes and the above-mentioned alloy ingot is dropped into the above-mentioned recessed portion by the above-mentioned turn-over assisting member.

In such a turn-over assisting member, rotation of the turning member is not inhibited by designing an amount of bending at the time of abutment of the alloy ingot so as not to inhibit the rotation of the turning member, so that the turning member (turning mechanism) can be prevented from being damaged.

Specifically, as described above, when the turn-over assisting member is formed and curved so that the concave curve may be formed on the upper surface side of the above-mentioned hearth, its lower end is supported by and fixed, and its upper end is formed as a free end, then it is a so-called cantilever spring, and it is possible to increase the amount of bending when the alloy ingot abuts it.

Further, it is desirable that the above-mentioned turn-over assisting member is formed in the shape of a dome which is downwardly concave in section, the above-mentioned turn-over assisting member is arranged to cover at least an upper end of the above-mentioned recessed portion, on which a perimeter edge of the above-mentioned turning member swings upwards.

According to such a turn-over assisting member, even if the alloy ingot is flipped off upwards by rotation of the turning member, it hits an inner surface of the turn-over assisting member, so that the alloy ingot M can be prevented from running out of the recessed portion. As a result, it is possible to prevent the apparatus from being damaged and avoid an accidental stoppage when the apparatus is continuously operated.

Alternatively, the above-mentioned turn-over assisting member may be formed in the shape of a cylinder having a predetermined length and having at least an opening at its lower end, and the above-mentioned opening may be arranged to cover at least the upper end of the above-mentioned recessed portion, on which the perimeter edge of the above-mentioned turning member swings upwards.

According to such a turn-over assisting member, even if the alloy ingot is flipped off upwards by rotation of the turning member, it hits the inner surface of the turn-over assisting member (or it does not hit the inner surface) and falls and returns into the recessed portion again, so that the alloy ingot can be prevented from running out of the recessed portion.

Further, it is desirable that the above-mentioned turn-over assisting member is disposed at a predetermined distance above the upper surface of the above-mentioned hearth and electrically insulated from the above-mentioned hearth.

Further, it is desirable that the above-mentioned turn-over assisting member is formed of a material with a thermal conductivity of 200 W/m·K or more, for example, copper or an alloy containing copper.

Thus, since the turn-over assisting member is separated and disposed at a predetermined distance from the hearth, it is possible to prevent the arc electric discharge between the heating mechanism (electrode) and the turn-over assisting member from generating. Further, when the turn-over assisting member is formed of such a material, even if discharge current flows into the turn-over assisting member and a lot of heat is provided at once, it is possible to prevent the turn-over assisting member from melting.

Furthermore, it is desirable that the above-mentioned turning member is formed in the shape of a ring and has a through hole formed in the center, and the alloy ingot abutting the above-mentioned turn-over assisting member passes through the through hole of the above-mentioned turning member, and is dropped into the above-mentioned recessed portion.

Still further, the above-mentioned turning member may be in the shape of a semicircle ring or a partial ring having an arc partially.

Effects of the Invention

According to the present invention, it is possible to provide an arc melting furnace apparatus which can reduce an operation burden on a worker and shorten working hours.

DESCRIPTION OF THE PREFERRED EMBODIMENTS

Hereinafter, an arc melting furnace apparatus 1 of the preferred embodiment of the present invention will be described with reference to the drawings.

First, an example of the whole structure of the arc melting furnace apparatus 1 in accordance with the first preferred embodiment of the present invention will be described with reference to FIGS. 1 to 4.

Figure 1:
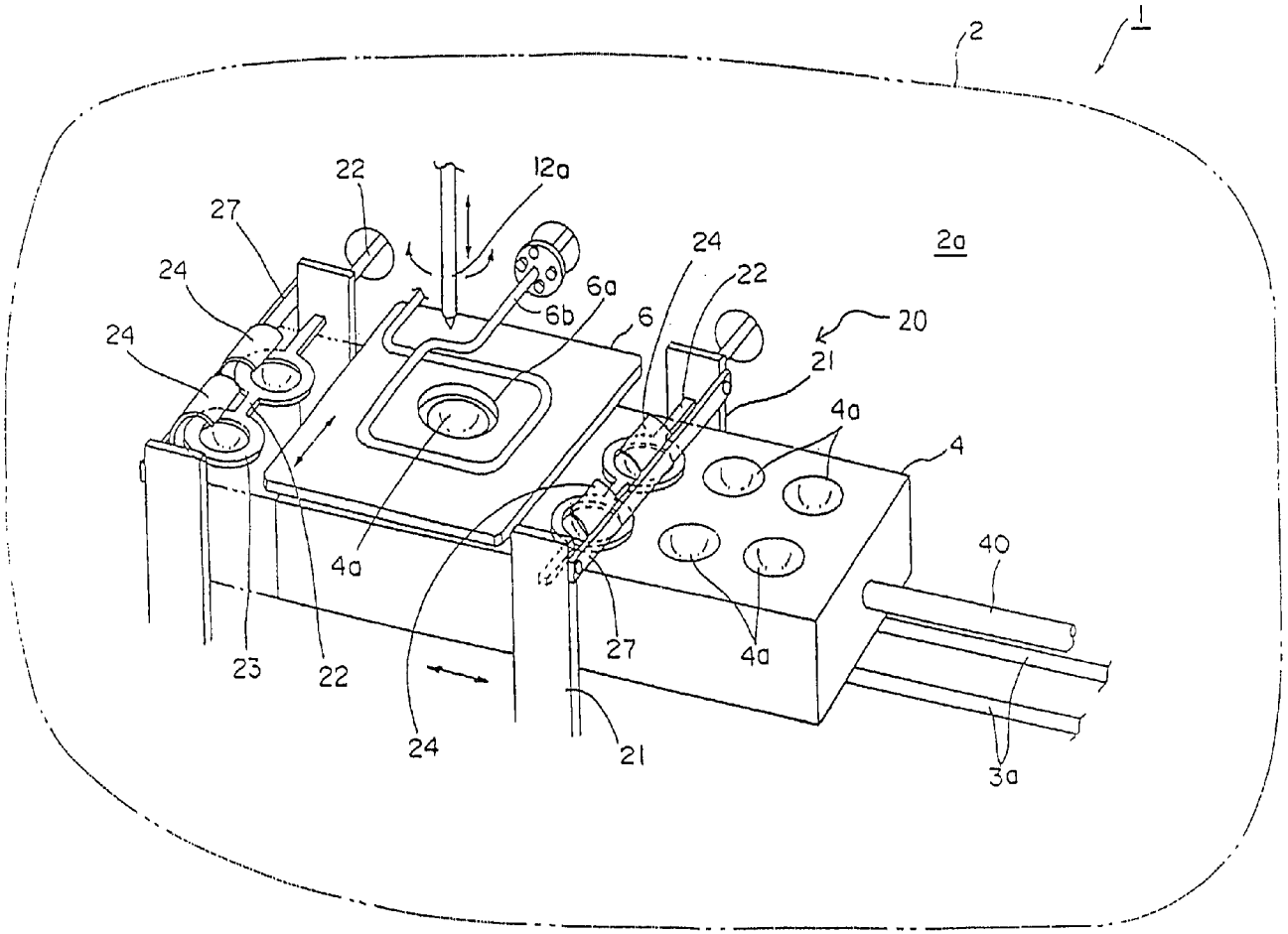
[FIG. 1] A schematic perspective view showing the inside of a melting chamber of an arc melting furnace apparatus in accordance with a first preferred embodiment of the present invention.
Figure 2:
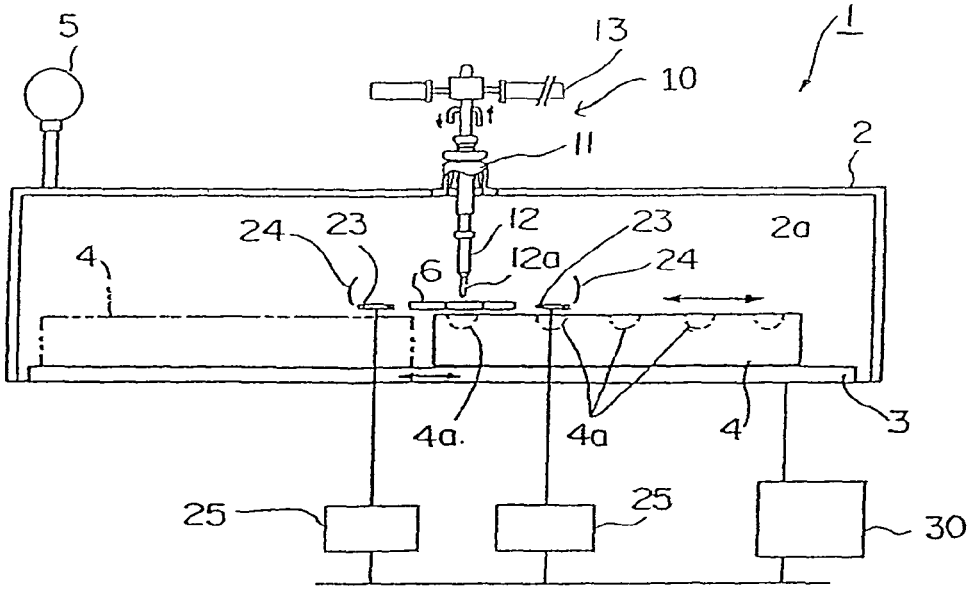
[FIG. 2] A schematic diagram showing the whole structure of the arc melting furnace apparatus in accordance with the first preferred embodiment of the present invention.

As shown in FIGS. 1 and 2, the arc melting furnace apparatus 1 includes a housing 2 having formed therein a melting chamber 2*a*, a guide mechanism 3 provided within the melting chamber 2*a*, a water-cooled copper hearth 4 supported by the guide mechanism 3, a heating mechanism 10 for heating and melting a metal material placed on the hearth 4 to produce an alloy ingot, a turning mechanism 20 for automatically turning the alloy ingot obtained by heating and melting the above-mentioned metal material placed on the hearth 4, and a controller 30 (see FIG. 2) for controlling operation of the whole apparatus.

Further, a vacuum pump 5 (see FIG. 2) is attached to the above-mentioned housing 2, and the melting chamber 2*a* is evacuated with this vacuum pump 5 to be vacuum.

In addition, an inert gas feeder (not shown) is provided, and inert gas is supplied from this inert gas feeder into the melting chamber 2*a* and enclosed therein so that the inside of melting chamber 2*a* is of an inert gas atmosphere.

Further, each structure of the arc melting furnace apparatus 1 of the preferred embodiment will be described in detail.

It should be noted that since the arc melting furnace apparatus 1 of the preferred embodiment is characterized by the structure of the turning mechanism 20, the structure of the turning mechanism 20 will be described in detail below, and the other structures will be briefly described.

As shown in FIG. 2, the above-mentioned heating mechanism 10 is provided with a holding pipe 11 for holding a cathode provided at an upper surface part of the melting chamber 2*a*, and an electrode (for example, water-cooled electrode) 12 held at a universal joint (not shown) provided in the holding pipe 11. The above-mentioned universal joint allows the above-mentioned electrode 12 to move up and down, back and forth, and to the left and right in the melting chamber 2*a*. Further, a tungsten member (cathode) 12*a* is provided at a tip portion of the electrode 12. It should be noted that the tungsten member 12*a* provided at the tip portion of the electrode 12 is arranged in a position to confront an upper surface of the hearth 4.

Further, it is arranged that a handle 13 is provided at an upper part of the holding pipe 11, and a worker uses a light aperture and a peephole (not shown) which are formed at the melting chamber 2*a*, so that the electrode 12 can be operated with the handle 13 with checking by viewing.

As shown in FIGS. 1 and 2, the above-mentioned guide mechanism 3 supports the hearth 4 and allows the hearth 4 to reciprocate according a control signal from the controller 30 in a predetermined direction of the melting chamber 2*a* (longitudinally of the housing 2).

It should be noted that a particular structure of the above-mentioned guide mechanism 3 is not specifically limited, but the guide mechanism 3 may be constituted by, for example, a guide rail 3*a* laid along the longitudinal direction of the housing 2 and a movable body (not shown) which is slidably supported on the guide rail 3*a* and reciprocatingly operates on the guide rail 3*a*. In this guide mechanism 3, the hearth 4 is fixed on this movable body (not shown), and the hearth 4 is moved by reciprocating this movable body on the guide rail 3*a* by a motor, for example.

Further, as shown in FIGS. 1 and 2, the above-mentioned water-cooled copper hearth 4 is formed substantially in the shape of a rectangular parallelepiped, and a plurality of hemispherical recessed portions (crucibles) 4*a* for accommodating the metal materials and melting them are formed on the upper surface of the hearth. The plurality of recessed portions (crucibles) 4*a* are formed to be aligned along a shorter-side direction (two recessed portions are aligned) and arranged at regular intervals along the longitudinal direction.

Furthermore, in order to cause an inner surface of the recessed portion (crucible) 4*a* to be at a predetermined temperature, a cooling pipe (not shown) is formed within the above-mentioned hearth 4. As shown in FIG. 1, a cooling-water supply pipe 40 (see FIG. 1) which supplies cooling water from the outside is provided for this cooling pipe.

As such, since it is arranged that the cooling pipe is formed within the above-mentioned hearth 4 to circulate cooling water, it is possible to adjust the temperature of the hearth 4 upper surface (temperature of the inner surface of the recessed portion (crucible) 4*a*).

As shown in FIGS. 1 and 2, a table 6 is provided in a position to confront the electrode 12 within the melting chamber 2*a*. This table 6 prevents the hearth 4 and the adjacent recessed portion (crucible) 4*a* from being polluted by small particles generating and scattering during an arc melting process and is supported by and fixed to a frame (not shown) provided at the bottom of the melting chamber 2*a*.

Further, a through hole 6*a* (see FIG. 1) is formed in the table 6. This through hole 6*a* is formed to have a diameter so that the electrode 12 operated by a handle 13 may pass therethrough and operation of melting the metal material accommodated in the recessed portions 4*a* may be performed by the electrode 12 that has passed through this through hole 6*a*.

Furthermore, a water-cooled pipe 6*b* for preventing heating deformation is provided in the table 6.

Still further, the above-mentioned turning mechanisms 20 confront each other across the electrode 12 and arranged on both sides of the electrode 12. As shown in FIG. 1, the turning mechanism 20 is provided with a pair of supporting members 21 standing within the melting chamber 2*a* on both sides of the hearth 4 which moves along the guide mechanism 3, a rotation shaft 22 which is rotatably supported at upper ends of the supporting members 21 and confronts the upper surface of the hearth 4, a turning member 23 which is provided for the rotation shaft 22 and rotated with the rotation shaft 22, a turn-over assisting member 24 formed of a resilient plate and provided above the above-mentioned moving hearth 4 and near the outside of a locus of the above-mentioned turning member 23, and a drive means 25 (see FIG. 2) for rotating the rotation shaft 22.

It should be noted that the rotation shaft 22, the turning member 23, and the turn-over assisting member 24 are desirably formed of a metal material having a rust prevention effect (for example, stainless steel).

Figure 3:
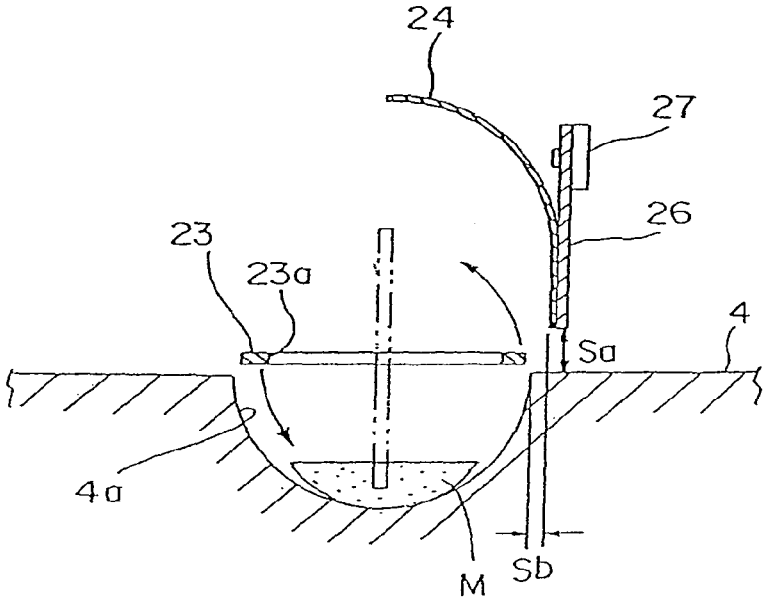
[FIG. 3] A schematic view showing a section of a recessed portion of a hearth, a turning member, and a turn-over assisting member of the arc melting furnace apparatus in accordance with the first preferred embodiment of the present invention.

As shown in FIG. 3, this turning member 23 is formed in the shape of a ring and has a through hole 23*a* formed in the center of a disc. As the rotation shaft 22 (see FIG. 1) rotates, the turning member 23 rotates and its perimeter edge is arranged to rotate and move along the inner surface of the recessed portion 4*a* formed in the hearth 4. As this turning member 23 rotates, the alloy ingot M generated in the recessed portions 4*a* is lifted above the hearth 4 and turned over.

Two turning members 23 are formed at the rotation shaft 22 respectively for two recessed portions 4*a* formed along the shorter-side direction (perpendicular to the longitudinal direction) of the above-mentioned hearth 4. With this structure, the alloy ingots M generated within the two recessed portions 4*a* formed along the shorter-side direction of the hearth 4 can be turned over at once.

It should be noted that the turning member 23 is formed integrally with the rotation shaft 22 in FIG. 1, but the present invention is not particularly limited thereto. For example, the rotation shaft 22 and the turning member 23 may be separately formed then integrally combined.

As shown in FIG. 3, the above-mentioned turn-over assisting member 24 is formed of a resilient plate and stands at one of upper ends of the recessed portion 4*a* of the hearth 4 moved by the guide mechanism 3 so as to cover a region around the one upper end.

In particular, the turn-over assisting member 24 is supported and fixed by the board 26 supported by the supporting member 21 in such a way that the lower end of the turn-over assisting member 24 is at a predetermined distance Sa upwardly from the upper end of the above-mentioned recessed portion 4*a* and a predetermined distance sb outwardly from the upper end.

Further, the above-mentioned turn-over assisting member 24 is formed and curved so that a concave curve may be formed on an upper surface side of the above-mentioned hearth 4, its lower end is supported and fixed by the board 26, and its upper end is formed as a free end. It should be noted that the above-mentioned board 26 is attached to a side plate 27 which bridges between the pair of supporting members 21 standing on both sides of the hearth 4 moved by the guide mechanism 3.

Since the turn-over assisting member 24 is arranged in this way, if the above-mentioned alloy ingot separates from the turning member 23 and goes outside (outside the locus of the turning member 23), the above-mentioned alloy ingot M abuts the turn-over assisting member 24. In this case, it is arranged that while the above-mentioned turn-over assisting member 24 is bent to some extent by the above-mentioned alloy ingot M and the turn-over assisting member 24 in a bent state returns to its original state, it urges the above-mentioned alloy ingot so that the above-mentioned alloy ingot may be returned into the recessed portion 4*a*.

Specifically, since the above-mentioned turn-over assisting member 24 is formed and curved so that the concave curve may be formed on the upper surface side of the above-mentioned hearth 4, its lower end is supported by and fixed to the board 26, and its upper end is formed as a free end (which is a so-called cantilever spring), and it is possible to increase an amount of bending when the alloy ingot abuts it.

Further, since the lower end of the turn-over assisting member 24 is arranged at a predetermined distance Sa upwardly from the upper end of the above-mentioned recessed portion 4*a* and a predetermined distance sb outwardly from the upper end, the turn-over assisting member 24 can be arranged outside the locus of the turning member 23. Furthermore, it is possible to increase the upper region around the recessed portion 4*a* covered by the turn-over assisting member 24. In addition, the predetermined distances Sa and Sb are suitably determined according to a dimension and a shape of the alloy ingot.

Since the above-mentioned turn-over assisting member 24 is provided, even if the alloy ingot goes out of the locus of the turning member 23, it can be returned into the recessed portion 4*a* and the operation can be continued.

Further, since the turn-over assisting member 24 is resilient, even if the above-mentioned alloy ingot M is caught between the turning member 23 and the turn-over assisting member 24, the turn-over assisting member 24 can flex, a heavy load is not applied to the turning member 23, and rotation of the turning member 23 is not inhibited, thus damage on the turning member 23 and failure of the drive means 25 can be prevented.

Figure 4:
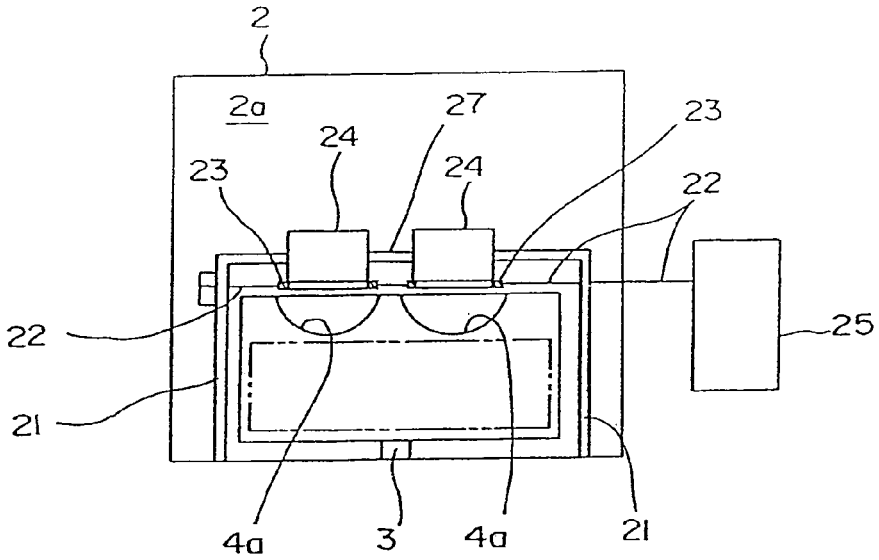
[FIG. 4] A schematic diagram showing a structure of a turning mechanism in accordance with the first preferred embodiment of the present invention.

As shown in FIG. 4, the above-mentioned drive means 25 is arranged outside the housing 2 and connected with the rotation shaft 22 extending from the inside of the melting chamber 2*a* to the outside, so as to rotate the rotation shaft 22 according to the signal from the controller 30. It should be noted that the above-mentioned drive means 25 may be any type of drive means that can rotate the rotation shaft 22 according to the control signal from the controller 30. For example, a servo motor etc. can be used.

Further, the above-mentioned controller 30 is constituted by a computer provided with a memory and CPU, receives various demands from the worker through an input means (a keyboard, console panel, etc., not shown) and controls the operation of the arc melting furnace apparatus 1. Furthermore, a control program for controlling the operation of the arc melting furnace apparatus 1 is stored in the above-mentioned memory. The function of the controller 30 is realized when the above-mentioned CPU performs the above-mentioned control program stored in the above-mentioned memory.

Next, the operation of the turning mechanism 20 of the preferred embodiment will be described with reference to FIG. 2, and FIGS. 5 and 6. It should be noted that the alloy ingot M illustrated in FIGS. 5 and 6 shows a cooled and solidified state.

First, the worker operates the electrode 12 using the handle 13, heats and melts the metal material supplied into the recessed portion 4*a* of the hearth 4, to thereby produce the alloy ingot M inside the recessed portions 4*a*.

When the alloy ingot M is generated, the guide mechanism 3 controlled by the controller 30 is driven, the hearth 4 is slid, the recessed portion 4*a* in which the alloy ingot M is accommodated is moved to a position to confront the turning member 23 (moved to a position under the turning member 23).

Figure 5:
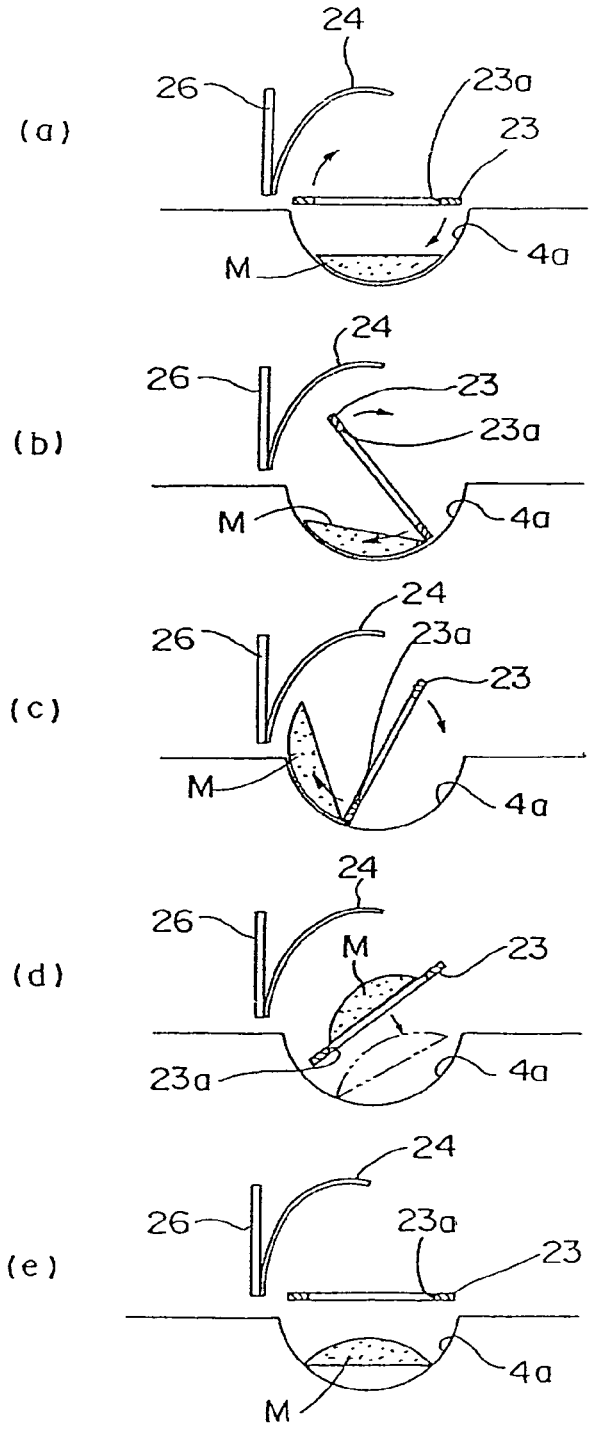
[FIG. 5] A schematic diagram for explaining operation of the turning mechanism in accordance with the first preferred embodiment of the present invention.
Figure 6:
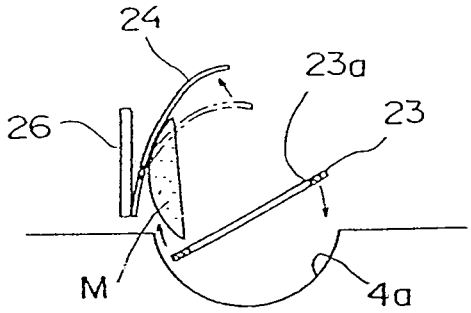
[FIG. 6] A schematic diagram for explaining operation of the turning mechanism in accordance with the first preferred embodiment of the present invention.
Figure 6:
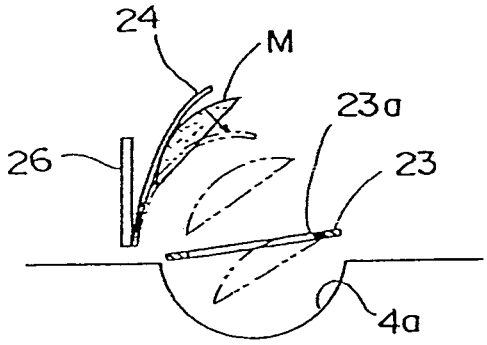
Figure 6:
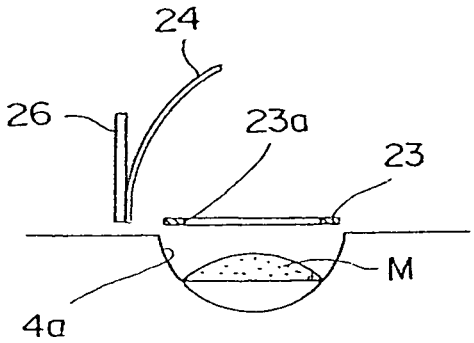

Thereby, as shown in FIG. 5(*a*), the recessed portion 4*a* in which the thus generated alloy ingot M is accommodated confronts the turning member 23.

Then, the drive means 25 is driven with instructions (control signal) from the controller 30 to rotate the turning mechanism 20, thus rotating the turning member 23.

When this turning member 23 begins to rotate, the perimeter edge of the turning member 23 rotates and moves along the inner surface of the recessed portion 4*a*. As shown in FIGS. 5(*b*) and 5(*c*), the alloy ingot M in the recessed portion 4*a* is pushed by the perimeter edge (perimeter edge of ring-shaped member) of the turning member 23, and moves up along the inside of the recessed portions 4*a*.

Since one end of the above-mentioned alloy ingot M is pushed and moved by the perimeter edge of the turning member 23, when the above-mentioned one end moves to the upper end of the recessed portion 4*a*, torque arises due to the self weight of the alloy ingot M, which is turned upside down above the turning member 23 (see FIGS. 5(*c*) and 5(*d*)).

The above-mentioned alloy ingot M turned upside down passes through the through hole 23*a* of the turning member 23 and falls into the recessed portion 4*a*. As a result, the above-mentioned alloy ingot M having fallen is accommodated upside down in the recessed portion 4*a* as shown in FIG. 5(*e*).

In addition, after turning it over as described above, the hearth 4 is slid again, and the above-mentioned alloy ingot M turned over is moved to below the electrode 12, heated, and melted again. Subsequently, the process of cooling, turning over, and melting is repeated a plurality of times, to thereby obtain a desired quality of alloy ingot M.

Further, in the process of rotating the above-mentioned turning member 23, the alloy ingot M may go outside the locus of the turning member 23 without the alloy ingot M rotating above the turning member 23 due to the material, weight, etc. of the alloy ingot M which is melted and generated, as shown in FIG. 6 (*a*).

That is, if the above-mentioned alloy ingot M separates from the turning member 23 and runs outside while the turning member 23 is rotating, then the alloy ingot M abuts the turn-over assisting member 24 arranged near the outside of the locus of the turning member 23.

As shown in FIGS. 6(*a*) and 6(*b*), if the above-mentioned alloy ingot M abuts the turn-over assisting member 24, then the turn-over assisting member 24 is deformed and bent by a predetermined amount, subsequently it urges the alloy ingot M towards the recessed portion 4*a* while the turn-over assisting member 24 in the bent state returns to its original state.

As a result, as shown in FIGS. 6(*b*) and 6(*c*), the alloy ingot M urged by the turn-over assisting member 24 passes from above the recessed portion 4*a* through the through hole 23*a* of the turning member 23, is promptly turned over, drooped into the recessed portion 4*a*, and accommodated upside down within the recessed portion 4*a*.

As described above, according to the first preferred embodiment, it is arranged that the perimeter edge of the turning mechanism 20 rotates and moves along the inner surface of the recessed portion 4*a* of the hearth 4 so that the alloy ingot generated in the recessed portion 4*a* may be lifted above the hearth and turned over. Therefore, like the conventional technology, the turning bar is operated from the outside of the melting chamber, and it is possible to avoid the troublesome work of hooking the material and turning It over by the tip portion of the turning bar, reduce the operation burden on the worker, and shorten working hours.

Furthermore, in the preferred embodiment, standing on one side of the upper end the recessed portion 4*a* of the hearth 4, the turn-over assisting member 24 which covers the one region is provided, so that the alloy ingot M can be caught by the turn-over assisting member 24 and returned to the recessed portion 4*a*, even in the case where the alloy ingot M lifted above the hearth 4 by the rotation of the turning member 23 separates from the locus of the turning member 23. That is, it is possible to prevent the alloy ingot M from running out of the recessed portion 4*a*.

Especially, the turn-over assisting member 24 is constituted by the resilient member to flex by a predetermined amount, so that when the alloy ingot M abuts the turn-over assisting member 24, the rotation of the turning member 23 is not inhibited, thus damage on the turning member 23 and failure of the drive means 25 can be prevented.

Figure 7:
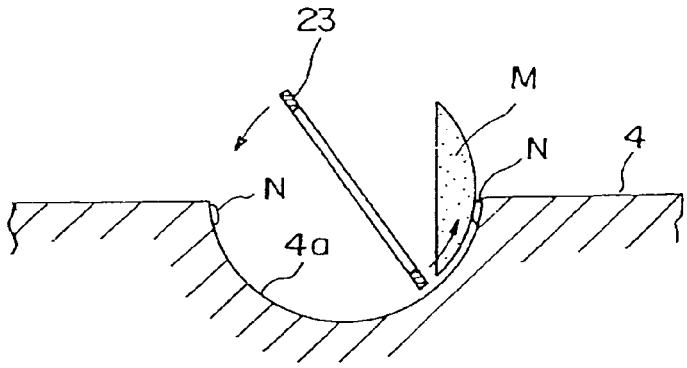
[FIG. 7] A schematic diagram showing a section of the recessed portion of the hearth, the turning member, and the turn-over assisting member of the arc melting furnace apparatus for explaining another problem which may arise in the first preferred embodiment of the present invention.
Figure 7:
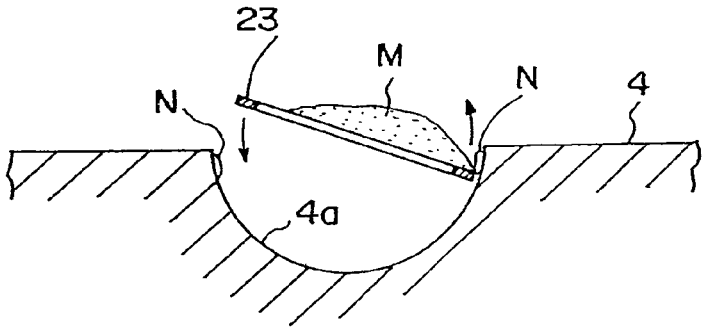
Figure 7:
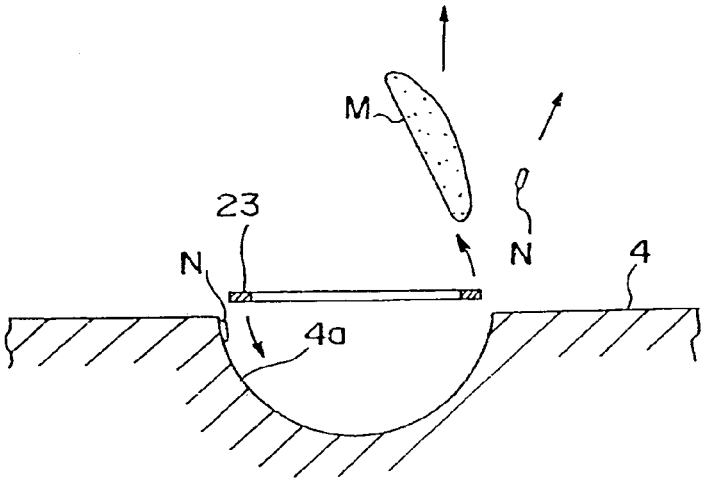

It should be noted that in the arc melting furnace apparatus 1 as illustrated with reference to the above-mentioned first preferred embodiment, as for each of the recessed portions 4*a* as shown in FIG. 7(*a*), when stirring the alloy ingot continuously, a film-like alloy material adheres to the upper end and gradually accumulates (stack), resulting in a thick adherent material N.

In a situation where such an adherent material N exists, when rotating the turning member 23, the turning member 23 may be brought into contact with (engage with) the adherent material N as shown in FIG. 7(*b*). If the turning member 23 engages with the adherent material N, the running torque becomes large, and the adherent material N is removed, thus there is a possibility that the separated adherent material N may be flipped off as shown in FIG. 7(*c*). Or, if the contact between the turning member 23 and the adherent material N is canceled (if the edge goes over the adherent material N due to the deformation of the turning member 23), a rotational speed of the turning member 23 increases rapidly, and there is a possibility that the alloy ingot M may be flipped out of the recessed portion 4*a* at a high speed as shown in FIG. 7(*c*).

Then, a second preferred embodiment in accordance with the present invention which can solve such a problem will be described with reference to FIGS. 8 and 9. It should be noted that the second preferred embodiment is different from the above-mentioned first preferred embodiment in that the turn-over assisting member 31 different in shape is provided instead of the turn-over assisting member 24 in the above-mentioned first preferred embodiment.

Figure 8:
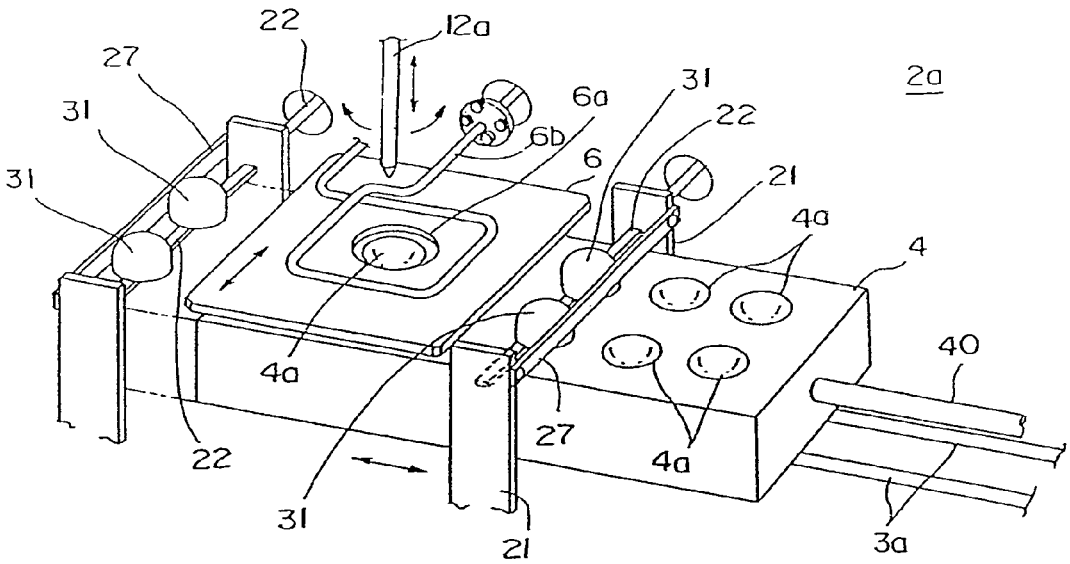
[FIG. 8] A schematic perspective view showing the inside of the melting chamber of the arc melting furnace apparatus in accordance with a second preferred embodiment of the present invention.
Figure 9:
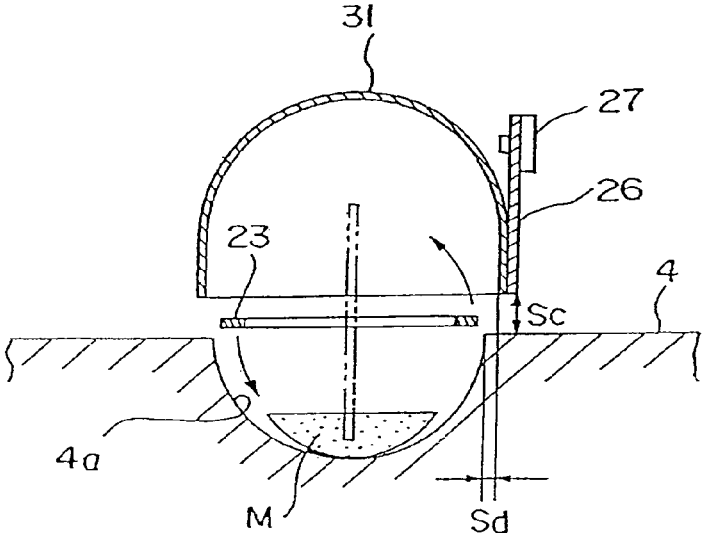
[FIG. 9] A schematic diagram showing a section of the turning member and the turn-over assisting member of the arc melting furnace apparatus in accordance with the second preferred embodiment of the present invention.

FIG. 8 is a perspective view showing the inside of the melting chamber 2*a* schematically, and FIG. 9 is a sectional view showing the turning member 23*a* and the turn-over assisting member 31. In FIGS. 8 and 9, components substantially the same as or corresponding to those explained above in the first preferred embodiment are given the same reference signs as in the embodiment.

As shown in FIGS. 8 and 9, in the second preferred embodiment, each turn-over assisting member 31 is formed in the shape of a dome which is downwardly concave in section.

This turn-over assisting member 31 has a thermal conductivity of 200 W/m·K or more, and is formed of a material (for example, copper or alloy containing copper) with thermal shock resistance.

Further, as with the above-mentioned first preferred embodiment, the turn-over assisting member 31 is supported and fixed by the board 26 supported by the side plate 27. In particular, one end of the turn-over assisting member 31 is arranged at a predetermined distance Sc upwardly from the upper end of the above-mentioned recessed portion 4*a* and a predetermined distance Sd outwardly from the upper end (upper end on the side in which the perimeter edge of the turning member 23 swings upwards).

It is desirable that the above-mentioned distance Sc is set to between 0.1% and 20% of a depth of the recessed portion 4*a*, according to a size of the alloy ingot M.

Here, arc electric discharge takes place between the electrode 12 (tungsten member 12*a*) and the recessed portion 4*a* of the installed hearth 4. Therefore, if the turn-over assisting member 31 is near the hearth 4, the arc electric discharge may take place at the turn-over assisting member 31.

Thus, since it is arranged that the turn-over assisting member 31 is separated from the hearth 4 by the distance Sc, the side plate 27 is made of a ceramic material, etc., it is insulated from the housing 2 (or, it is located in an electrically isolated state), whereby the arc electric discharge between the electrode 12 (the tungsten member 12*a*) and the turn-over assisting member 31 is prevented from taking place. Further, when the turn-over assisting member 31 is formed of such a material (as described above), even if discharge current flows into the turn-over assisting member 31 and a lot of heat is provided at once, it is possible to prevent the turn-over assisting member 31 from melting.

Further, it is desirable that the above-mentioned distance Sd is set to around 5 mm, for example. Thus, the turn-over assisting member 31 is arranged to cover at least the upper end of the recessed portion 4*a* on the side in which the perimeter edge of the turning member 23 swings upwards. Preferably, as illustrated, the outside of the locus of the turning member 23 and the whole recessed portion 4*a* are covered by the turn-over assisting member 31, without inhibiting the rotation of the turning member 23.

According to the turn-over assisting member 31 with such a structure, even in the case where the alloy ingot M lifted above the hearth 4 by rotation of the turning member 23 separates from the locus of the turning member 23, the alloy ingot M can be caught by the turn-over assisting member 31, turned over, dropped into, and promptly returned to the recessed portion 4*a*.

Further, even if the turning member 23 abuts the adherent material generated at the upper end of the recessed portion 4*a* and the adherent material or the alloy ingot M are flipped off, they hit an inner surface of the turn-over assisting member 31, so that the alloy ingot M can be prevented from running out of the recessed portion 4*a*.

As such, according to the second preferred embodiment in accordance with the present invention, as with the above-mentioned first preferred embodiment, not only the alloy ingot M can be turned over and dropped promptly into the recessed portion 4*a* by the turn-over assisting member 31 having the shape of a dome which is downwardly concave in section, but also it is possible to prevent the alloy ingot M etc. from running out of the recessed portion 4*a*, which may be caused by the turning member 23 contacting the adherent material generated at the upper end of the recessed portion 4*a*.

Figure 10:
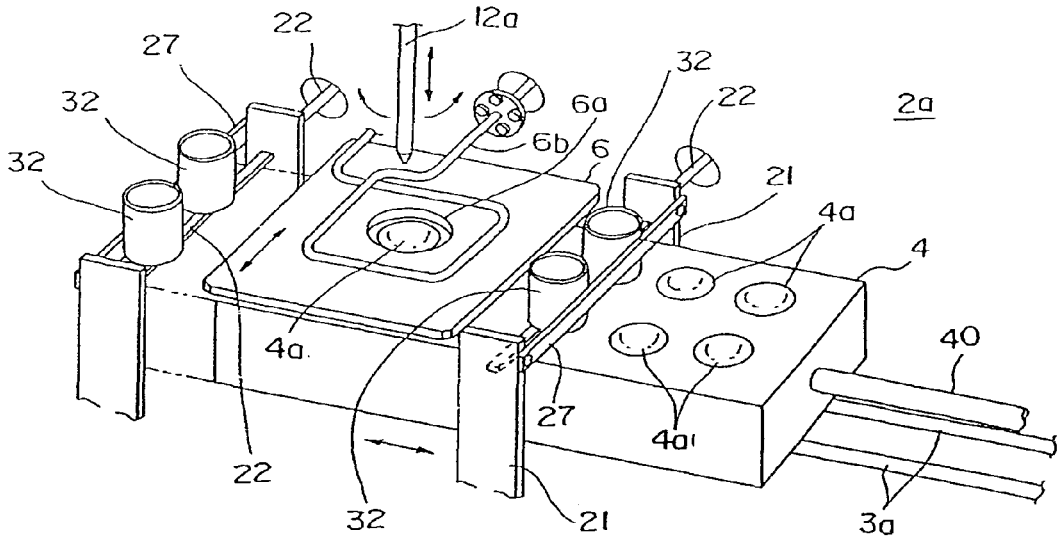
[FIG. 10] A schematic perspective view showing the inside of the melting chamber of the arc melting furnace apparatus in accordance with a third preferred embodiment of the present invention.
Figure 11:
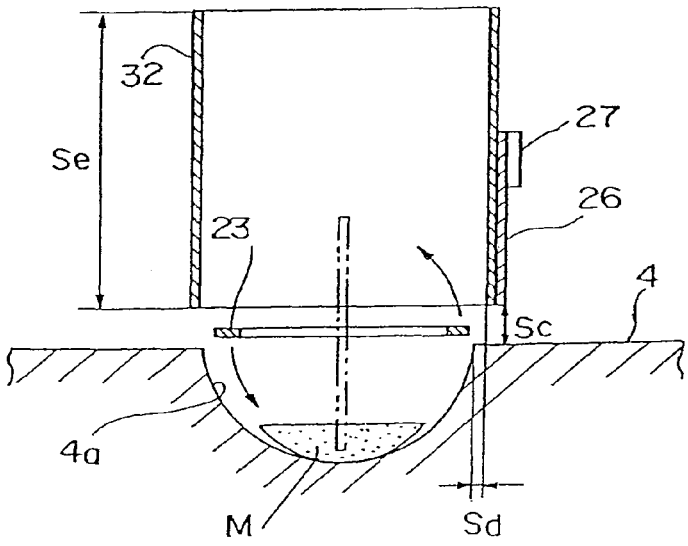
[FIG. 11] A schematic diagram showing a section of the turning member and the turn-over assisting member of the arc melting furnace apparatus in accordance with the third preferred embodiment of the present invention.

Then, a third preferred embodiment in accordance with the present invention will be described with reference to FIGS. 10 and 11. FIG. 10 is a perspective view schematically showing the inside of the melting chamber 2*a*, and FIG. 11 is a sectional view showing the turning member 23*a* and a turn-over assisting member 32.

The third preferred embodiment is different from the above-mentioned second preferred embodiment in that the turn-over assisting member 32 is provided instead of the turn-over assisting member 31. In particular, the turn-over assisting member 32 is different from the turn-over assisting member 31 shown in FIGS. 8 and 9 only in shape, and is in the shape of a cylinder having openings at its upper and lower ends as illustrated.

As with the above-mentioned second preferred embodiment, the turn-over assisting member 32 is supported and fixed by the board 26 supported by the side plate 27. In particular, as with the second preferred embodiment, one end of the turn-over assisting member 32 is arranged at a predetermined distance Sc upwardly from the upper end of the above-mentioned recessed portion 4*a* and a predetermined distance Sd outwardly from the upper end (upper end on the side in which the perimeter edge of the turning member 23 swings upwards).

Thus, the lower opening of the turn-over assisting member 32 is arranged to cover at least the upper end of the recessed portion 4*a* on the side in which the perimeter edge of the turning member 23 swings upwards. Preferably, as illustrated, the whole recessed portion 4*a* is covered by the lower opening of the turn-over assisting member 32.

Further, in order to prevent the alloy ingot M from running out of the recessed portion 4*a*, a height (cylinder length) Se of the turn-over assisting member 32 is arranged to be at least about the depth of the recessed portion 4*a* or more.

The maximum height (cylinder length) Se may be a height at which it does not hit the ceiling of the housing 2, but in fact it is desirably formed to have a margin after checking a height at which the alloy ingot M may jump and bound.

Furthermore, it is also desirable that the material for the turn-over assisting member 32 may be a material similar to that in the above-mentioned second preferred embodiment.

According to such a cylindrical turn-over assisting member 32, even in the case where the alloy ingot M lifted above the hearth 4 by rotation of the turning member 23 separates from the locus of the turning member 23, the alloy ingot M can be caught by the turn-over assisting member 32, turned over, dropped into, and promptly returned to the recessed portion 4*a*.

Further, even if the turning member 23 abuts the adherent material generated at the upper end of the recessed portion 4*a* and the adherent material or the alloy ingot M are flipped off upwards, they hit an inner surface of the turn-over assisting member 32 (or they do not hit the inner side) and fall into the recessed portion 4*a* again, so that the alloy ingot M can be prevented from running out of the recessed portion 4*a*.

As such, according to the third preferred embodiment, not only the alloy ingot M can be turned over and dropped promptly into the recessed portion 4*a* by providing the cylindrical turn-over assisting member 32, but also it is possible to prevent the run-out of the alloy ingot M etc., which may be caused by the turning member 23 contacting the adherent material generated at the upper end of the recessed portion 4*a*, as with the above-mentioned second preferred embodiment.

It should be noted that, in the third preferred embodiment, although the turn-over assisting member 32 is in the shape of a cylinder having openings at its upper and lower ends, the upper end may be closed with a lid (not shown) (i.e. it may be in the shape of a cylinder and opened at least at the lower end).

Further, the present invention is not limited to the above-described preferred embodiments, and various modifications are possible within the scope of the invention. For example, in the above-described preferred embodiments, although the turning member 23 is rotated by the drive means 25 constituted by a servo motor etc., the present invention is not particularly limited thereto. It may be arranged that a handle connected to the rotation shaft 22 is provided and a worker turns the handle to rotate the turning member 23.

Furthermore, in the above-mentioned preferred embodiments, although the hearth 4 is of a rectangular parallelepiped, its upper surface may be circular and a plurality of recessed portions 4*a* may be arranged on concentric circles along the circumference.

Still further, in the above-described preferred embodiments, the recessed portions 4*a* are arranged in two rows in a direction perpendicular to the direction of movement of the power-driven hearth 4 (the shorter-side direction), but the present invention is not limited to two rows, and one row may be applied. Yet further, it is possible to arrange much more recessed portions 4*a* (for example, three rows or more). When this is the case, it is preferable that the hearth 4 may be power driven in both the orthogonal directions according to the control signal.

Furthermore, in the above-described preferred embodiment, although the rotation shaft 22 is arranged in parallel with the upper surface of the hearth 4, the rotation shaft 22 is not necessarily in parallel with the upper surface of the hearth 4 in the case where the recessed portions 4*a* are arranged in one row in the direction perpendicular to the direction of movement of the power-driven hearth 4 (the shorter-side direction). For example, when wishing to arrange the rotation shaft 22, the drive means 25, and a joint for transmitting rotational movement in a smaller space, it is possible to employ a structure in which the turning member 23 is inserted from the side and above into the recessed portion 4*a* (i.e. situation where the rotation shaft 22 is not parallel with the upper surface of the hearth but has a predetermined tilt angle therebetween). The above-mentioned tilt angle needs to be 45° or less. In particular, the angle is determined by the size of the alloy ingot M and the shape of the alloy ingot M (raw alloy ingot), the shape being determined by wettability of the hearth 4, etc.

Figure 12:
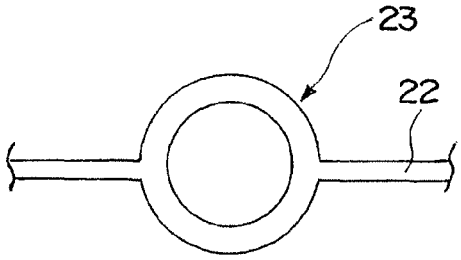
[FIG. 12] A plan view for explaining modifications of the turning member in accordance with the preferred embodiment of the present invention.
Figure 12:
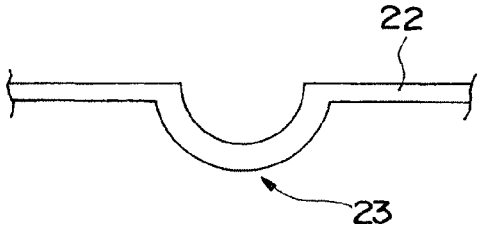
Figure 12:
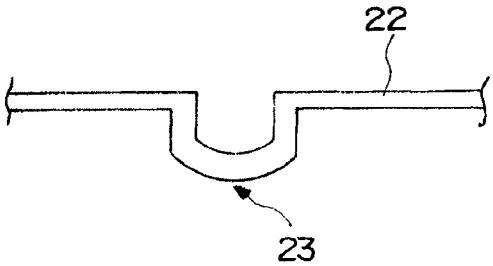
Figure 12:
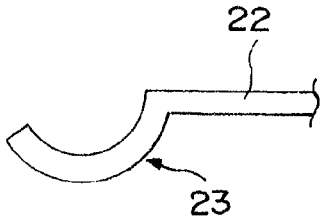
Figure 13:
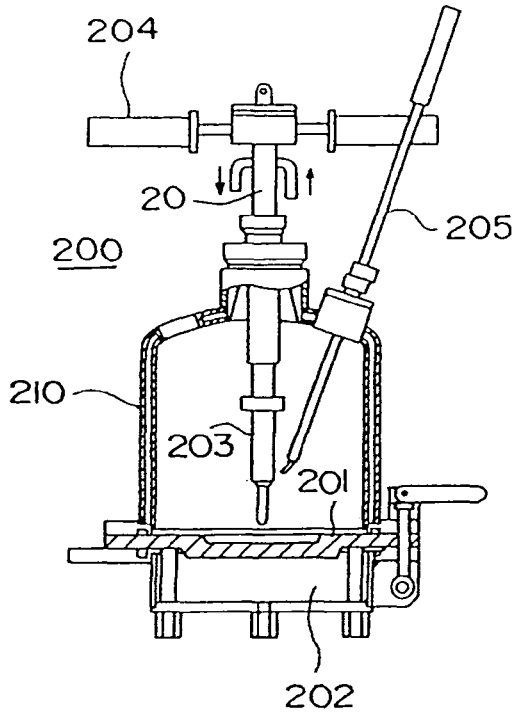
FIG. 13 PRIOR ART
[FIG. 13] A sectional view showing a melting furnace of a conventional technology.
Figure 14:
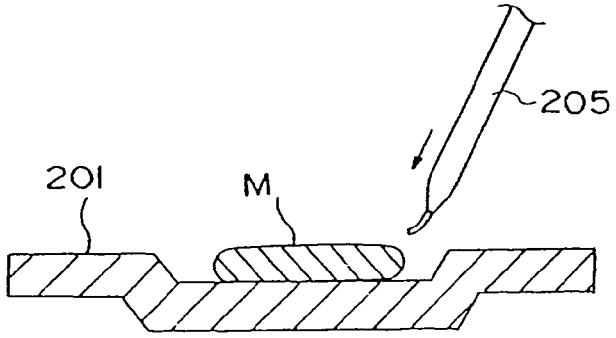
FIG. 14 PRIOR ART
[FIG. 14] A sectional view showing how a metal material is turned over in the melting furnace of FIG. 13.

As shown in FIG. 12(*a*), in the above-described preferred embodiment, the turning member 23 is formed in the shape of a ring, but it is not limited thereto. The turning member 23 may be of any shape as long as it rotates due to rotation of the rotation shaft 22 (see FIG. 1), its perimeter edge is arranged to rotate and move along the inner surface of the recessed portion 4*a* formed in the hearth 4, and the alloy ingot M generated in the recessed portion 4*a* can be lifted above the hearth 4 and turned over.

For example, the turning member 23 may be formed in the shape of a semicircular ring obtained by cutting a ring having formed therein (in the center) a through hole into two halves as shown in FIG. 12(*b*), or in the shape of a partial ring having a partial circle as shown in FIG. 12(*c*). Furthermore, in the case where the turning member 23 is in the shape of a partial ring as shown in FIG. 12(*d*), even if one of the left and right rotation shafts 22 is missing (a partial ring is formed at the tip portion of the rotation shaft 22), then the partial ring may only be in the shape to match the size of the alloy ingot M.

EXPLANATION OF REFERENCE SIGNS

M: alloy ingot
1: arc melting furnace apparatus
2: housing
2*a*: melting chamber (housing)
3: guide mechanism
3*a*: guide rail (guide mechanism)
4: hearth
4*a*: recessed portions (hearth)
5: vacuum pump
6: table
6*a*: through hole (table)
6*b*: water-cooled pipe (table)
10: heating mechanism
11: holding pipe (heating mechanism)
12: electrode (heating mechanism)
12*a*: tungsten member (cathode (heating mechanism))
13: handle (heating mechanism)
20: turning mechanism
21: supporting member (turning mechanism)
22: rotation shaft (turning mechanism)
23: turning member (turning mechanism)
23*a*: through hole (turning member (turning mechanism))
24: turn-over assisting member (turning mechanism)
25: drive means (turning mechanism)
26: plate (turning mechanism)
27: side plate (turning mechanism)
30: controller
31: turn-over assisting member (turning mechanism)
32: turn-over assisting member (turning mechanism)

What is claimed is:

1. An arc melting furnace apparatus including a housing having formed therein a melting chamber, a hearth provided within said melting chamber and having a recessed portion, and a heating mechanism for heating and melting a metal material supplied into said recessed portion to generate a raw alloy ingot, said apparatus comprising:

a turning member rotatably supported on a supporting member standing within said melting chamber, a perimeter edge of the turning member rotating and moving along an inner surface of said recessed portion to lift the alloy ingot generated in said recessed portion above the hearth and turn it over, and a turn-over assisting member provided above said recessed portion and outside a locus of said turning member, wherein when said alloy ingot abuts the turn-over assisting member, said alloy ingot is dropped into said recessed portion by said turn-over assisting member.

2. An arc melting furnace apparatus as claimed in claim 1, wherein said turn-over assisting member is formed of a resilient plate so that a concave curve may be formed above said hearth, the turn-over assisting member being supported and fixed at its lower end, its upper end being formed as a free end, when said alloy ingot abuts said turn-over assisting member, the turn-over assisting member flexes and said alloy ingot is dropped into said recessed portion by said turn-over assisting member.

3. An arc melting furnace apparatus as claimed in claim 1, wherein said turn-over assisting member is formed in the shape of a dome which is downwardly concave in section, said turn-over assisting member is arranged to cover at least an upper end of one side of said recessed portion, on which a perimeter edge of said turning member swings upwards.

4. An arc melting furnace apparatus as claimed in claim 1, wherein said turn-over assisting member is formed in the shape of a cylinder having a predetermined length and having at least an opening at its lower end, said opening is arranged to cover at least an upper end of one side of said recessed portion, on which a perimeter edge of said turning member swings upwards.

5. An arc melting furnace apparatus as clamed in claim 1, wherein said turn-over assisting member is disposed at a predetermined distance from an upper surface of said hearth and electrically insulated from said hearth.

6. An arc melting furnace apparatus as claimed in claim 5, wherein said turn-over assisting member is formed of a material having a thermal conductivity of 200 W/m·K or more.

7. An arc melting furnace apparatus as claimed in claim 6, wherein said turn-over assisting member is formed of copper or an alloy containing copper.

8. An arc melting furnace apparatus as claimed in claim 1, wherein said turning member is formed in the shape of a ring and has a through hole formed in the center, and the alloy ingot abutting said turn-over assisting member passes through the through hole of said turning member, and is dropped into said recessed portion.

9. An arc melting furnace apparatus as claimed in claim 1, wherein said turning member is in the shape of a semicircle ring or a partial ring having an arc partially.

* * * * *